US005250745A

United States Patent [19]

Tsumura

[11] Patent Number: 5,250,745

[45] Date of Patent: Oct. 5, 1993

[54] KARAOKE MUSIC SELECTION DEVICE

[75] Inventor: Mihoji Tsumura, Osaka, Japan

[73] Assignee: Ricos Co., Ltd., Osaka, Japan

[21] Appl. No.: 881,818

[22] Filed: May 12, 1992

[30] Foreign Application Priority Data

Jul. 31, 1991 [JP] Japan ..... 3-216106

[51] Int. Cl.[5] ..... G10H 3/00; G10H 7/00

[52] U.S. Cl. ..... 84/603; 84/609

[58] Field of Search ..... 84/601-603, 84/609-614, 634-638, 645, DIG. 12, DIG. 22

[56] References Cited

U.S. PATENT DOCUMENTS 4,546,687 10/1985 Minami ..... 84/601

5,131,311 7/1992 Murakami et al. ..... 84/601 X

*Primary Examiner*—Stanley J. Witkowski

*Attorney, Agent, or Firm*—Thompson, Hine and Flory

[57] ABSTRACT

The invention provides an indication for a karaoke singer of that music in the karaoke music library which would be best suited to the singer's own vocal characteristics. For the purpose of providing this indication, the singer's voice signals are first of all sampled at suitable intervals and the sample waveforms converted into specimens made up of digital values. A body of data relating to vocal characteristics is at the same time stored in the device, each item of said data being assigned its own code. When the above specimens are input, they are compared with the stored data by an evaluation means which then identifies the items of data that resemble each other most closely. The codes which are incorporated into the data items so identified are then treated as retrieval items and any library data with a matching code for each of a plurality of pieces of music is duly retrieved and the music with the matching code is extracted.

6 Claims, 1 Drawing Sheet

KARAOKE MUSIC SELECTION DEVICE

BACKGROUND OF THE INVENTION

1. Field of the Invention

The invention is an ancillary device for use with a karaoke music reproduction device. The object of the invention is to enable individual singers to select and examine for reference purposes the sorts of music best suited to their own singing abilities from a library of music designed for reproduction as karaoke music.

2. Description of the Prior Art

In the case of karaoke, the normal situation is for a singer to flip through a music library list, generally kept in book form, in order to identify and request the sorts of music that suit his taste. However, if the singer finds, after making his selection, that the key of the music he has chosen does not suit his voice range then, provided the karaoke system he is using is also fitted with a key adjustment controller, he will be able to alter the musical key to match his voice.

Using this type of system, it is a simple matter just to change the musical key. At the same time, however, it must also be said that that is all it is and there is no ultimate guarantee that the singer will then be able to perform the song in a way that is properly in keeping with the basic mood of the music. The elements that go to make up a piece of music involve a wide variety of parameters, such as pitch, note length and tempo, all of which have a powerful all-pervasive effect on the musical reproduction, combining as they do to create many and varied impressions on the listener. Songs too can be divided into those which are best suited to a full voice, for example, and those which are better suited to, say, a husky voice or a coarse voice. The singer himself, however, finds it difficult to distinguish objectively between those pieces of music that he likes and those that best suit the quality of his voice with the result that karaoke singers frequently request songs which are not right for them. As a result, there is also a strong desire among singers to find out what sort of music suits their voices best. At the moment, however, there are no karaoke systems which cater to this kind of requirement.

SUMMARY OF THE INVENTION

The object of the invention is to provide a device whereby, after random sampling of the voice of a singer who is singing through a microphone, it will be possible to indicate to that singer what sort of music is best suited to the qualities of his voice.

This will in turn be of considerable help to the singer when making future karaoke music selections.

The means to this end include first a sampling means which samples at appropriate intervals the voice signals input from a microphone during the course of karaoke singing, and then a means for the conversion of the waveforms collected by way of the sampling process to digital signals for the purpose of creating a voice specimen. The karaoke music selection device of the invention can then be completed by the addition of an evaluation means, which contains a wide range of stored data relating to a selection of vocal characteristics each of which is assigned a code such that, when said voice specimen is input, a comparison can be made and any data with a sufficiently close resemblance duly identified, and a voice matching means, which, by reference to the codes output by said evaluation means, retrieves the library data relating to pieces of karaoke music to which similar codes have been assigned and finally extracts those pieces of music for which the codes form a complete match. The objects, design and benefits of the present invention may be clarified by reference to the following detailed description and the accompanying drawing.

DESCRIPTION OF THE PREFERRED EMBODIMENT

Figure 1:
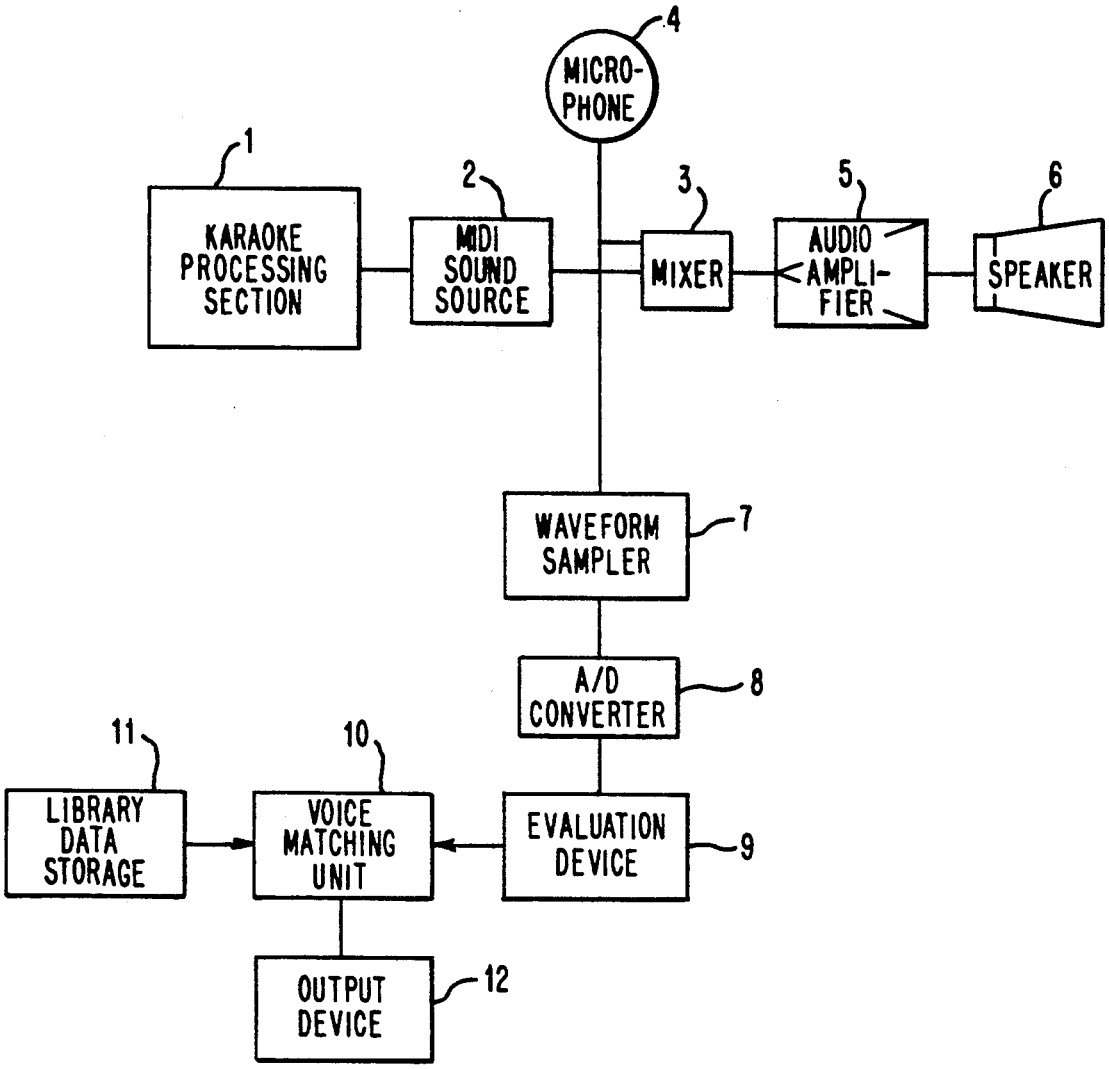
FIG. 1 is a block diagram showing the preferred embodiment of the invention.

There follows a detailed description of the preferred embodiment of the invention by reference to the accompanying drawing.

FIG. 1 illustrates the device of the present invention in relation to the relevant parts of a karaoke music reproduction device. In essence, a karaoke music reproduction device must comprise an element for the display of lyrics and visual images but, since this element is not directly relevant to the present invention, it has been omitted from the configuration shown in the drawing. The karaoke data of the present invention is of the type disclosed in, for example, U.S. Pat. No. 5,046,004 and U.S. Ser. No. 07/605,506 and consists, in the case of the music, of MIDI music data and, in the case of the lyrics, of character based lyric data. Depending on the type of system in use, karaoke data may be retrieved by downloading by way of a public telephone line from database in a host computer or else retrieved from an optical disk housed in the local karaoke unit itself. It goes without saying, of course, that these are just two of many possibilities and that, for the purposes of the present invention, it makes no difference which of the known karaoke systems is used. In the drawing, 1 is the karaoke processing section, which comprises a variety of elements such as a buffer memory and a sequencer grouped around a central microprocessor. If karaoke data is to be downloaded from an external center, then the processing section must also include a modem while, if said data is to be stored internally, on the other hand, a memory device such as an optical disk unit will be required. 2 is a MIDI sound source, which receives MIDI signals output from the karaoke data processing section 1, converts said MIDI signals to audio signals in accordance with the MIDI standard, and inputs them to the mixer 3 through one of the mixer's input terminals. 4 is the singer's microphone, which is connected to the other mixer 3 input terminal. The signals received by the mixer 3 through each of its two input terminals are duly mixed and output to further essential downstream elements such as an audio amplifier 5 and finally a speaker 6 from which they are output in the form of sounds.

7 is a waveform sampler, which receives parallel input, along with the mixer 3, of signals from the microphone 4. Under normal circumstances, the waveform sampler 7 receives signal input exclusively from said microphone 4. Moreover, while the system is in use, said input waveforms are subject to sampling at intervals of, say, 30 seconds, said sample waveforms being output successively to a downstream A/D converter 8. As an alternative to regular automatic waveform sampling, a separate switch (omitted from the drawing) could equally be used, for example, to enable sampling to be carried out only in response to the output of a trigger signal. The A/D converter 8 quantizes each sample waveform and inputs the resultant signals to an evaluation device 9 in the form of a specimen represented by digital quantities. The evaluation device 9 is designed to assess the characteristics of the singer's voice on the basis of the specimen received and holds an appropriate amount of prestored quantized human voice data for the purpose of comparison. Each item of comparison data is assigned a code which indicates a correspondence with one or other of the characteristics of the human voice. Said comparison data codes are structured in such a way as to enable them to be used as a basis for the derivation of information such as whether the voices represented by said comparison data are clear or husky, for example. The comparison data itself should preferably be stored in the form of a table containing voice data relating to a wide range of different vocal characteristics. Clearly, the ultimate precision of the evaluation of the vocal characteristics represented by a specimen will be to a large extent determined by the degree of sophistication incorporated into said comparison data.

The evaluation device 9 compares the input specimen data with the comparison data, which it holds in memory, selects the comparison data with the nearest data value to the quantized data and outputs the associated code to a voice matching unit 10. If the evaluation of more than one specimen results in the extraction of more than one different code, it is equally acceptable either to output all of said codes or else to preassign a priority order to each of the codes used by the evaluation device 9 and to output only those codes to which the highest priority has been assigned. One or other of these methods may be selected for use at any one time. 11 is a library data storage area in which is stored data in coded form relating to a variety of musical characteristics. Each piece of music contained in the karaoke music library is distinguished in terms of the sort of vocal qualities for which it is best suited by a code structured in the same way as the comparison data codes referred to above, said vocal quality codes being listed in table form along with the song titles. The voice matching unit 10 accesses the library data storage area 11 on the basis of the comparison data code input it has received from the evaluation device 9, reads out the titles of any songs which are found to have matching codes and transmits them to an output device 12. Said output device 12 may be either a hardcopy printer or else the visual display means of the karaoke music reproduction device itself, the required selection of said output means being made by the user in accordance with personal preference.

We will now describe the sequence of operations of the present invention. First, on receipt of a request for a piece of music by the singer, the karaoke data processing section 1 either carries out the processing operations required to download the karaoke data corresponding to the singer's request from the host computer, or else it reads the required data from the karaoke data stored in an internal memory device. On receipt, the karaoke data is transmitted first to the MIDI sound source 2 from which it is then transferred by way of the mixer 3 and the audio amplifier 5 to the speaker 6 from which it is finally reproduced in the form of musical sounds. At the same time, the corresponding lyrics are displayed on a visual display unit (omitted from the drawing). Using the microphone 4, the singer is thus able to sing along with the music as it is reproduced. Up to this point, the system is similar to that of any ordinary karaoke music reproduction device. The signals generated by the microphone, however, are input in parallel both to the mixer 3 and also to a sampler 7 where they are subjected to sampling at appropriate intervals.

The resultant sample waveforms are in turn input to an A/D converter where they are converted to digital values and input as specimens into the evaluation device 9. The evaluation device 9 then compares the characteristics of the input data with the characteristics of a range of stored comparison data in order to determine the closest match.

The codes incorporated into the selected comparison data are then input to the voice matching unit 10 which examines the karaoke music related codes stored in the library data storage area 11 in order to identify those pieces of music which have matching codes. Said voice matching unit 10 then reads out the titles of those pieces of music adjudged to be best suited to the voice of the singer in question. There may be just one suitable title read out or there may be many. The suitable title or titles are finally presented to the singer by way of the output device 12, which means either displaying them on the visual display unit or else printing them out on a printer. The information value of the final data can be enhanced by presenting not just the titles of the pieces of music but also the original artist's names and other items of information at the same time. It should be remembered, moreover, that the evaluation made by the evaluation device 9 is concerned largely with the vocal characteristics of a specimen rather than with features such as the vocal strength or tempo of a performance.

The device of the preferred embodiment outlined above is thus able to sample the voice of a singer as he sings into a microphone and, on the basis of these samples, to create a set of specimen data which can then be compared with a variety of prestored data in order to find the closest match and finally, on the basis of this evaluation, to access a table of codes in order to select and output the titles of those pieces of karaoke music that appear best suited to the voice of said singer. The resulting information can be of some considerable use to the singer when he next uses the karaoke system.

Moreover, it has been assumed, for the purpose of the above explanation, that the singer's voice is sampled while he is using a karaoke reproduction device but, since the signals from the microphone 4 are input in parallel into both the mixer 3 and the sampler 7, the device of the preferred embodiment could just as easily be used in isolation from said karaoke system. This choice is left entirely in the hands of the user.

What is claimed is:

1. A karaoke music selection device comprising a sampling means which subjects voice signals converted by a microphone to sampling at suitable intervals, a conversion means which converts sample waveforms generated by said sampling means into specimens consisting of digital values, an evaluation means which holds a plurality of stored data items relating to various vocal characteristics to each of which a comparison data code is assigned, and which, on the input of specimens from said conversion means, compares said specimens with the plurality of stored data items and selects those data items which form the closest match, and a voice matching means which receives input of the comparison data codes assigned to the data items selected by said evaluation means, and which accesses library data relating to a plurality of pieces of karaoke music to which codes identical to said comparison data codes have been assigned, thereafter extracting those pieces of music with matching codes.

2. The karaoke music selection device according to claim 1 in which the conversion means is a D/A converter.

3. The karaoke music selection device according to claim 1 in which the microphone output is output in parallel with a separate karaoke music reproduction device.

4. The karaoke music selection device according to claim 1 in which the microphone output is transmitted continuously to a sampling means in which the sampling operation is timed to take place at suitable intervals.

5. The karaoke music selection device according to claim 1 in which the microphone output is transmitted continuously to a sampling means in which the sampling operation is timed in accordance with the manual input from a separate switch.

6. The karaoke music selection device according to claim 1 in which the library data is stored in a memory device in the form of a table.

* * * * *